US006382581B1

(12) United States Patent
Duff

(10) Patent No.: US 6,382,581 B1
(45) Date of Patent: May 7, 2002

(54) PAPER EASEL

(76) Inventor: Glen Wade Duff, 101 Harrop's Glen, Williamsburg, VA (US) 23185

( * ) Notice: Subject to any disclaimer, the term of this patent is extended or adjusted under 35 U.S.C. 154(b) by 0 days.

(21) Appl. No.: 09/515,899

(22) Filed: Feb. 29, 2000

(51) Int. Cl.[7] ..... A47F 1/00

(52) U.S. Cl. ..... 248/459; 248/460; 248/453; 248/174; 248/165

(58) Field of Search ..... 248/450, 453, 248/459, 460, 464, 463, 455, 454, 165, 174; 108/33

(56) References Cited

U.S. PATENT DOCUMENTS

| | | | | | |
|---|---|---|---|---|---|
| 582,333 | A | | 5/1897 | Wright | |
| 845,694 | A | | 2/1907 | Conelly | |
| 880,049 | A | * | 2/1908 | Stofflet | 248/450 |
| 1,411,281 | A | * | 4/1922 | Kellogg | 248/450 |
| 1,742,854 | A | * | 1/1930 | Ferguson | 248/450 |
| 2,277,494 | A | | 3/1942 | Loewenstein | |
| 2,587,316 | A | | 2/1952 | Henry | |
| 3,305,205 | A | | 2/1967 | Frankl | |
| 3,762,675 | A | | 10/1973 | Sankey | 248/464 |
| 3,990,669 | A | | 11/1976 | Smith | 248/459 |
| 4,318,527 | A | | 3/1982 | Smith | 248/459 |
| 4,377,271 | A | | 3/1983 | Smith | 248/460 |
| 4,610,416 | A | | 9/1986 | Choi | 248/459 |
| 5,660,365 | A | | 8/1997 | Glick | 248/459 |
| 5,755,423 | A | | 5/1998 | Michela | 248/459 |
| 5,782,452 | A | | 7/1998 | Bosworth | 248/459 |
| 5,868,373 | A | | 2/1999 | Duff | 248/459 |
| 5,941,496 | A | | 8/1999 | Banner | 248/459 |

* cited by examiner

*Primary Examiner*—Kimberly T. Wood
(74) *Attorney, Agent, or Firm*—Armstrong, Westerman & Hattori, LLP

(57) ABSTRACT

A paper easel for supporting one or more sheets of paper on a work surface includes a bendable sheet of material having a center panel separating a right wing panel from a left wing panel. The center panel is divided from the right wing panel by a right crease line such that the right wing panel is pivotable with respect to the center panel along the right crease line. Furthermore, the center panel is divided from the left wing panel by a left crease line such that the left wing panel is pivotable with respect to the center panel along the left crease line. Further, the left wing panel includes a bottom edge for resting on the work surface, and a left foot panel extending forwardly from a lower front portion thereof. The right wing panel also includes a bottom edge for resting on the work surface, and a right foot panel extending forwardly from a lower front portion thereof.

20 Claims, 6 Drawing Sheets

PAPER EASEL

BACKGROUND OF TIE INVENTION

The instant invention is directed to a paper easel for supporting at least one sheet of paper (or more) on a work surface. More particularly, the invention is directed to an inexpensive and easily manufactured paper easel. The paper easel in accordance with the instant invention is made of a sheet material and may be folded or unfolded to enable ease of transportation.

In the past, many different types of easels for supporting sheets of paper on a work surface have been used. For example, many paper easels have been made out of plastic. While a plastic easel is strong for supporting a sheet of paper, it is not easily folded for transportation, and is more expensive to manufacture. Metal paper easels have also been used, however, these are also expensive and difficult to transport.

It is an object to the instant invention to provide a paper easel which will easily support a sheet (or a plurality of sheets) of paper in a generally upright position in order to make it easy for a user to read the paper for typing information into a computer or for easy reference of printed pages when doing computer work or any other type of work.

It is another object to the invention to provide a paper easel which is easy and inexpensive to manufacture and has a printable surface that may be used for decoration and/or useful information.

It is still another object to the invention to provide a paper easel which has a section which may be used for display of personal items such as photographs and the like.

SUMMARY OF THE INVENTION

The disclosed paper easel, in accordance with the instant invention, is provided to overcome many problems with previous paper easels. Because the instant invention may be made from a sheet material, such corrugated cardboard, it is inexpensive to manufacture and may be provided to the customer at a low cost.

The paper easel in accordance with the instant invention is provided for supporting one or more sheets of paper on a work surface. The paper easel comprises a piece of bendable sheet material which has a center panel separating a right wing panel from a left wing panel. The center panel is divided from the right wing panel by a right crease line such that the right wing panel is pivotable with respect to the center panel along the right crease line. Further, the center panel is divided from the left wing panel by a left crease line such that the left wing panel is pivotable with respect to the center panel along the left crease line. The left wing panel includes a bottom edge for resting on the work surface and a left foot panel extending forwardly from a lower portion thereof. The left foot panel provides a surface upon which the lower edge of the sheet of paper will rest. Further, the right wing panel also includes a bottom edge for resting on the work surface and a right foot panel extending forwardly from a lower front portion thereof, also for supporting a lower edge of the sheet of paper.

In order for the paper easel, in accordance with the instant invention, to be inexpensive and light, is preferred that it be made out of corrugated cardboard, and especially in which the corrugations run generally perpendicular to a center line of the center panel. It is also preferred to provide a flute wire inserted within the left wing panel, center panel, and right wing panel, along a corrugation of the corrugated cardboard, in order to provide additional strength to the paper easel and to maintain the left and right wing panels in their desired position when folded into that desired position. Further, it is also preferable that the center panel of the paper easel includes opposing left and right ear portions extending laterally outwardly from left and right side edges of the center panel, and in the same plane thereof. The left and right ear portions form an enlarged center section in the center panel. This enlarged center section is designed to accommodate a photo or snap-shot holder therein. The snap-shot holder may be placed in a horizontal orientation or it may be placed in a vertical orientation. Because of the ear portions and the resulting center section, the instant paper easel is generic so that it may accommodate either the horizontal or vertical format for the photo holder. This center section, is sized so that it may accommodate a standard 3½×5 inch photo or a 4×6 inch photo. Furthermore, the center section may be provided with the aperture therein and the photo may be mounted on the rear face of the center section or center panel. Any type of acceptable rear mounting device may be used on the rear face of the center section or center panel.

An angle formed between the bottom edge of the wing panel and the crease line on each side determines at what angle the center panel is oriented. While it is possible for the angle to be 90°, that is the center panel is straight up and down, perpendicular to the work surface, it is much more preferable for the center panel be canted or leaned backward slightly (an angle less than 90°) with respect to the work surface. This will enable the sheet of paper or sheets of paper to more easily lean against the center panel. Thus, it is more preferable that the angle between the bottom edge of the wing panel and the crease line of each side be less than 90°. Thus, a paper easel in accordance with the instant invention can be inexpensive to manufacture and therefore inexpensive to purchase. It can be light and portable, and it can be a surface for advertising or personalization (with the use of photos) or it may simply have pleasing designs which a consumer would desire.

DETAILED DESCRIPTION OF THE INVENTION

Figure 1:
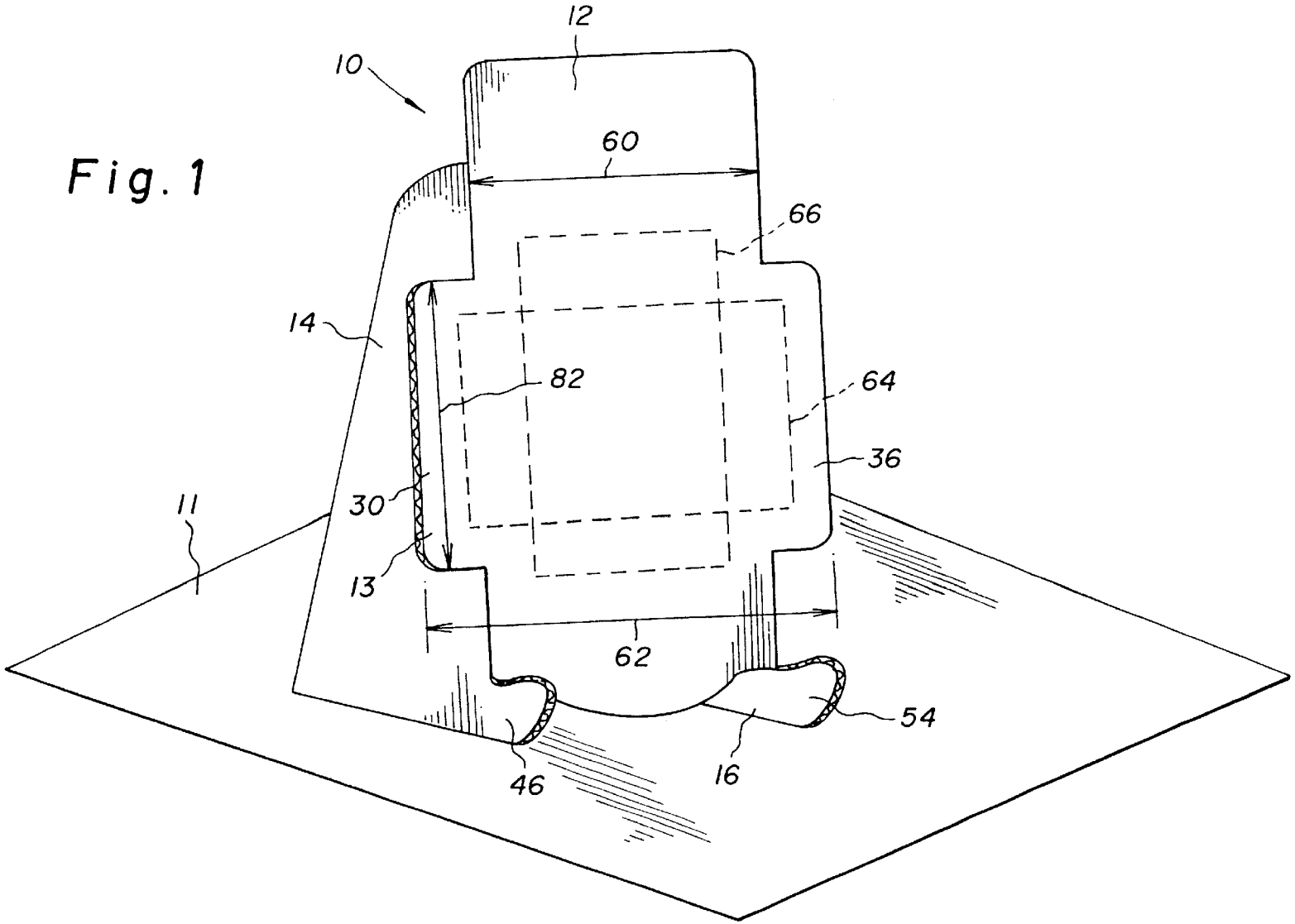
FIG. 1 is a perspective view of the paper easel in accordance with the instant invention.
Figure 2:
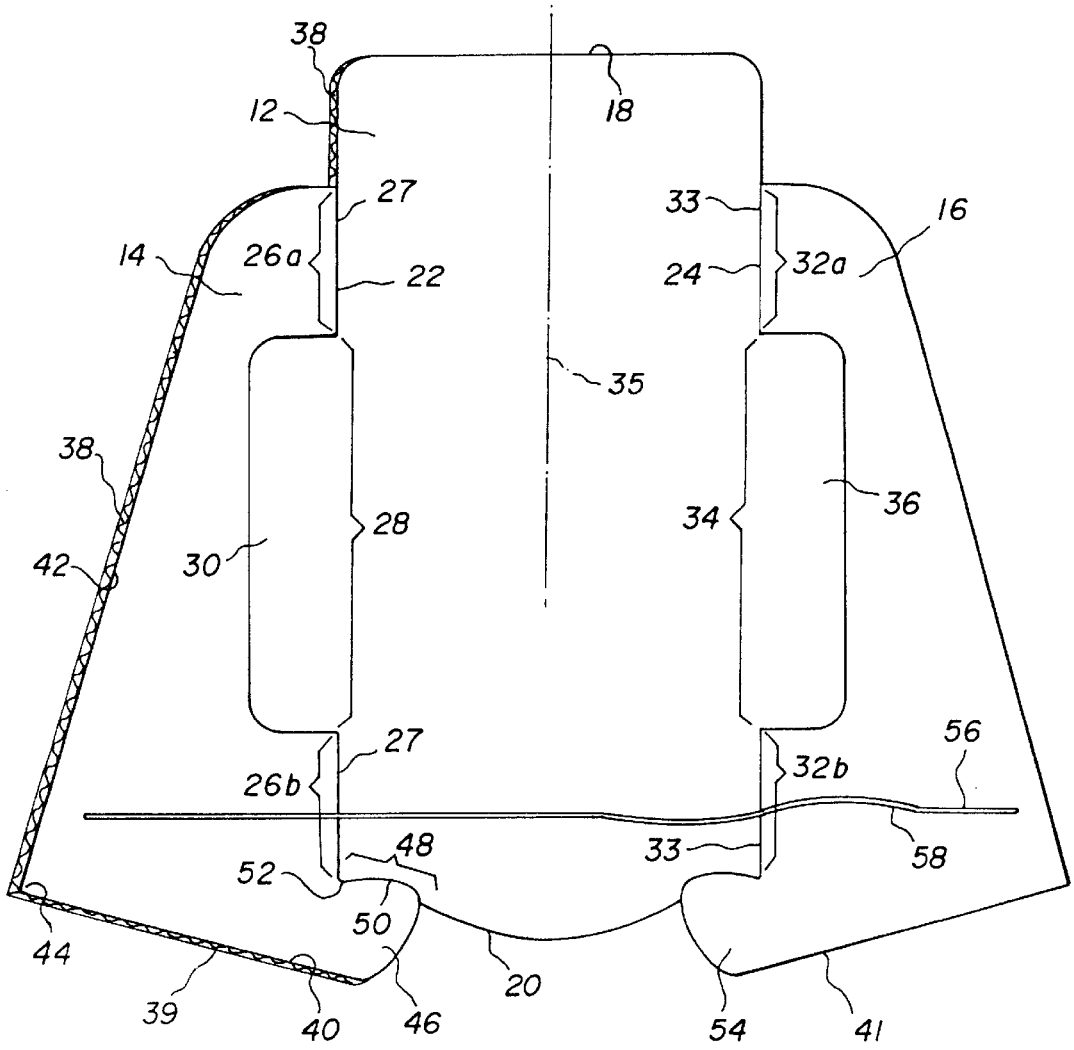
FIG. 2 illustrates the paper easel, in a flat state, before being folded into a usable state.

FIG. 1 is a perspective view of the instant invention, in which a paper easel is designated by reference numeral 10. As also seen in FIG. 2, paper easel 10 comprises a center panel 12 having a left wing panel 14 and a right wing panel 16 extending outwardly therefrom on opposite sides thereof. Paper easel 10 is preferably made of corrugated cardboard. FIG. 2 illustrates a form in which paper easel 10 is die cut from a corrugated cardboard blank (not shown). In FIG. 2, the paper easel 10 is in a flat state before being folded into a usable form. While corrugated cardboard is a preferred material, the instant paper easel may be made from any other appropriate type of sheet material, for example, corrugated cardboard with plasticized surfaces, corrugated plastic, plastic, wood, vinyl over paperboard, paper over paperboard, as well as any suitable cardboard or plastic product.

When manufactured, the outline or pattern of paper easel 10 is die cut into the cardboard blank (not shown) to form the paper easel 10. As shown in FIG. 1, paper easel 10 rests upon a work surface 11, such as a table or desk.

As illustrated in FIGS. 1 and 2, center panel 12 has a top edge 18, a bottom edge 20 and side edges 22 and 24. Generally, top edge 18 and bottom edge 20 are formed when paper easel 10 is die cut from the cardboard blank (not shown). Left side edge 22 is formed of crease portions 26*a* and 26*b*. Together, crease portions 26*a* and 26*b* form a crease line 27. Crease 26*a* is formed at the upper portion of left side edge 22, while crease portion 26*b* is formed at the lower edge of left side edge 22. In between is a cut portion 28. Cut portion 28 is actually cut when the cardboard plank is die cut. Left ear portion 30 extends generally laterally outward from the main portion of center panel 12. Crease portions 26*a* and 26*b* and cut portion 28 function to separate center panel 12 from left wing panel 14. Thus, crease line 27 divides center panel 12 from left wing panel 14 and allows left wing panel 14 to pivot with respect to center panel 12. Similarly, the right side of center panel 12 is the mirror image of the left side. Right side edge 24 has crease portions 32*a* and 32*b*, separated by cut portion 34. Also, crease portions 32*a*, 32*b* together form crease line 33. Thus, cut portion 34 enables the formation of right ear portion 36, also extending generally laterally outwardly from the main portion of center panel 12. Accordingly, crease line 33 divides center panel 12 from right wing panel 16 and allows right wing panel 16 to pivot with respect to center panel 12.

When in use, left wing panel 14 and right wing panel 16 are folded back along crease lines 27 and 33, respectively. Preferably, left and right wing panels 14, 16 should be folded approximately perpendicular to center panel 12. However, any useable angles between the center panel and left and right wing panels 14, 16, are acceptable. As illustrated by reference numeral 38, the paper easel 10 is preferably made from a corrugated material, and more specifically, from corrugated cardboard. Further, it is preferred that corrugations 38 run generally perpendicular to a center line 35 of center panel 12.

Left wing panel 14 includes a generally flat bottom edge 40 and a rear edge 42. Bottom edge 40, when left wing panel 14 is bent into the working position, is intended to stand upon work surface 11 (e.g., a table). Clearly, bottom edge 40 may also be in the form of a plurality of feet rather than one continuous surface. A rear comer 44 is also illustrated in FIG. 2, as the intersection between bottom edge 40 and rear edge 42. Opposite from rear comer 44, along bottom edge 40 (at a lower front portion of left wing panel 14) is foot panel 46. Foot panel 46 includes a cut portion 48 which is cut through during the die cutting process. Thus, when left wing panel 14 is folded back along with crease line 27, foot panel 46 is pivoted forward because it is no longer connected to center panel 12. Foot panel 46 has an upper edge 50 which has a depression 52 in order to provide a surface upon which the paper sheet rests. Right wing panel 16 is substantially the mirror image of left wing panel 14 and has right foot panel 54.

A flute wire 56 may be inserted into the corrugation of paper easel 10, as illustrated in FIG. 2. It is preferable to put a kink (as at 58) into flute wire 56 before insertion, so that it does not easily slip out. Flute wire 56 is inserted into a corrugation so that it spans left wing panel 14, center panel 12 and right wing panel 16. The flute wire, while not necessary, is beneficial in helping left wing panel 14 and right wing panel 16 remain bent at the desired angle, with respect to center panel 12, as it is set by the user. For transportation, when left and right wing panels 14, 16 are unfolded or bent back to the flat stage, the flute wire 56 will help maintain paper easel 10 in a flat stage. While 18 or 20 gauge flute wire is preferable, any appropriate gauge may be used.

As illustrated in FIG. 1, left ear portion 30 and right ear portion 36 are positioned opposite one another and are substantially the mirror images of one other. The normal width of center panel 12 is indicated by arrow 60. A preferable width 60 for center panel 12 is about 4½ inches. Although any size of center panel may be used, a width of about 4½ inches is preferred because it provide a proper combination of support, yet economy of material. Thus, a relatively narrow footprint can be provided, while ear portions 30,36 allow a larger sheet of paper to be supported than would be normal with such a small footprint. Because of left ear portion 30 and right ear portion 36, center panel 12 has a center section 13 of enlarged width represented by reference numeral 62. The enlarged area of center section 13 of center panel 12 also enables a snap-shot sized horizontal photograph holder 64 to be disposed on paper easel 10, as well as the illustrated vertically oriented snap-shot sized photograph holder 66. Reference numeral 64 represents a photograph holder for a 3½×5 inch or 4×6 inch sized snap-shot. Reference numeral 66 represents a vertically oriented photograph holder for holding a vertically oriented snap-shot of the same sizes. It is necessary to provide left and right ear portions 30,36 in order to properly support horizontal photograph holder 64. Thus, the location of left and right ear portions 30, 36 enables paper easel 10 to be of a generic shape that can accept either horizontal or vertical snap-shot sized photograph holders. While it is preferable to have about a ½ inch border around the photograph holder, center section 13 must be at least large enough to accommodate a 3½×5 inch or 4×6 inch photograph holder. Thus, the width 62 of center section 13, is preferably at least 5 inches, and 6 inches is more preferable. In fact, 7 inches or more is even more preferable to allow a sufficient border around a photograph holder. Accordingly, the height 82 of center section 13 is preferably at least 3½ inches and more preferably 4 inches. It is even more preferable that height 82 be 4½ inches or more to allow for a desired border on the top and bottom. While ear portions 30, 36 have been discussed in detail above, it is contemplated that even the ear portions are not necessary to practice in the instant invention.

Figure 3:
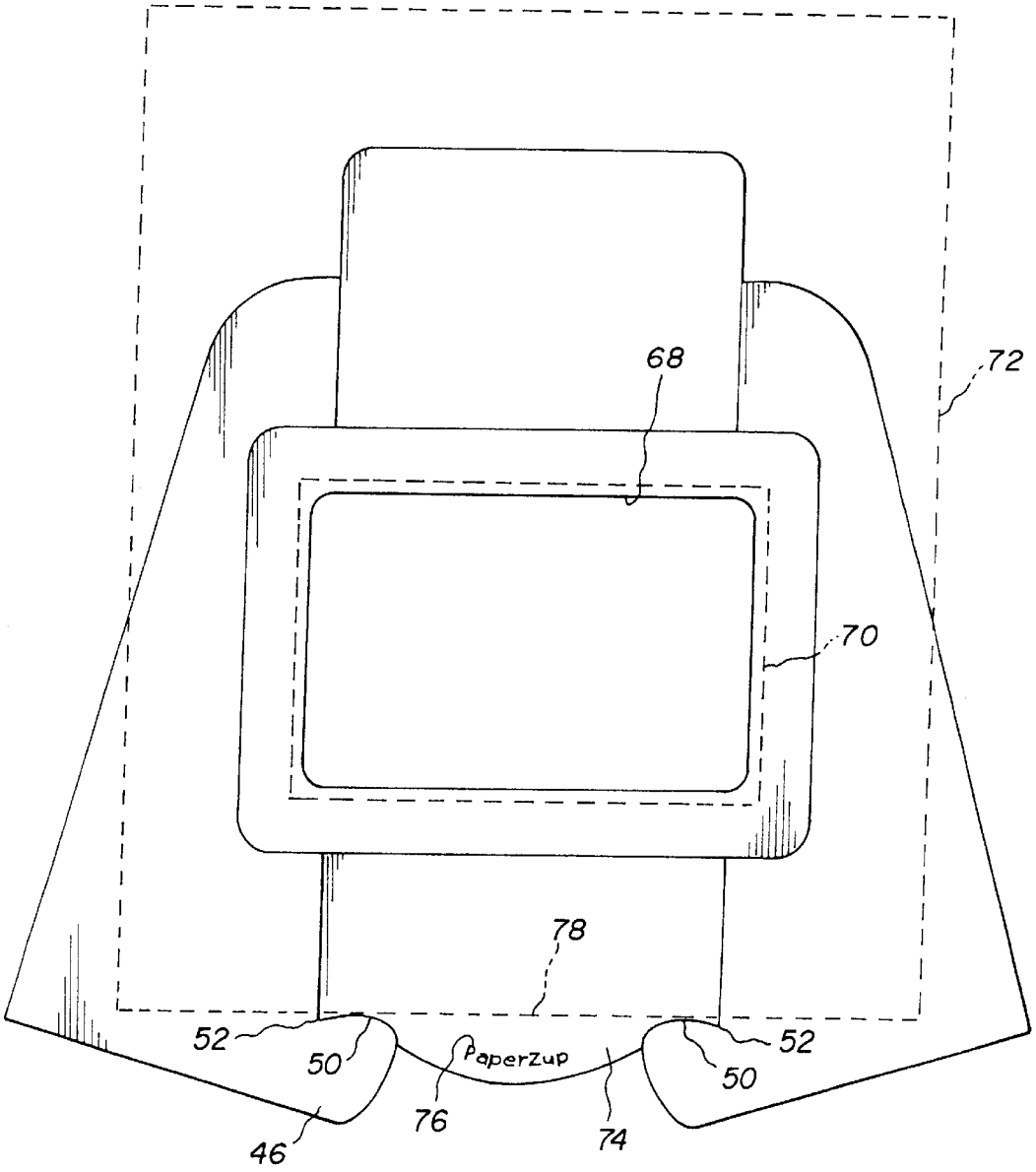
FIG. 3 illustrates the paper easel having an aperture in the center thereof.

FIG. 3 illustrates a slightly different version of paper easel 10 of FIG. 2. In FIG. 3, while the shape is substantially the same as in FIG. 2, a generally horizontally oriented aperture 68 is provided in center section 13 of center panel 12. Phantom lines 70 illustrate a photograph or snap-shot fixed to paper easel 10 on the rear face thereof Photograph 70 may be attached to the rear face of center panel 12 by any appropriate method.

FIG. 3 also illustrates (in phantom) a sheet of paper 72. Paper sheet 72 is illustrated in the position in which it would be located when in use. When in use, paper sheet 72 will rest on depression 52 of upper edge 50 of each of left and right foot panels 46, 54. As seen in FIG. 3, a downwardly projecting panel 74 extends downwardly from center panel 12. Downwardly projecting panel 74 extends below the lower edge 78 of paper sheet 72. Thus, no matter how many paper sheets are resting upon left and right foot panels 46, 54, downwardly projecting panel 74 will always be visible. Accordingly, downwardly projecting panel 74 is an ideal place for locating a logo (illustrated as reference numeral 76) or other type of design or information.

Figure 4:
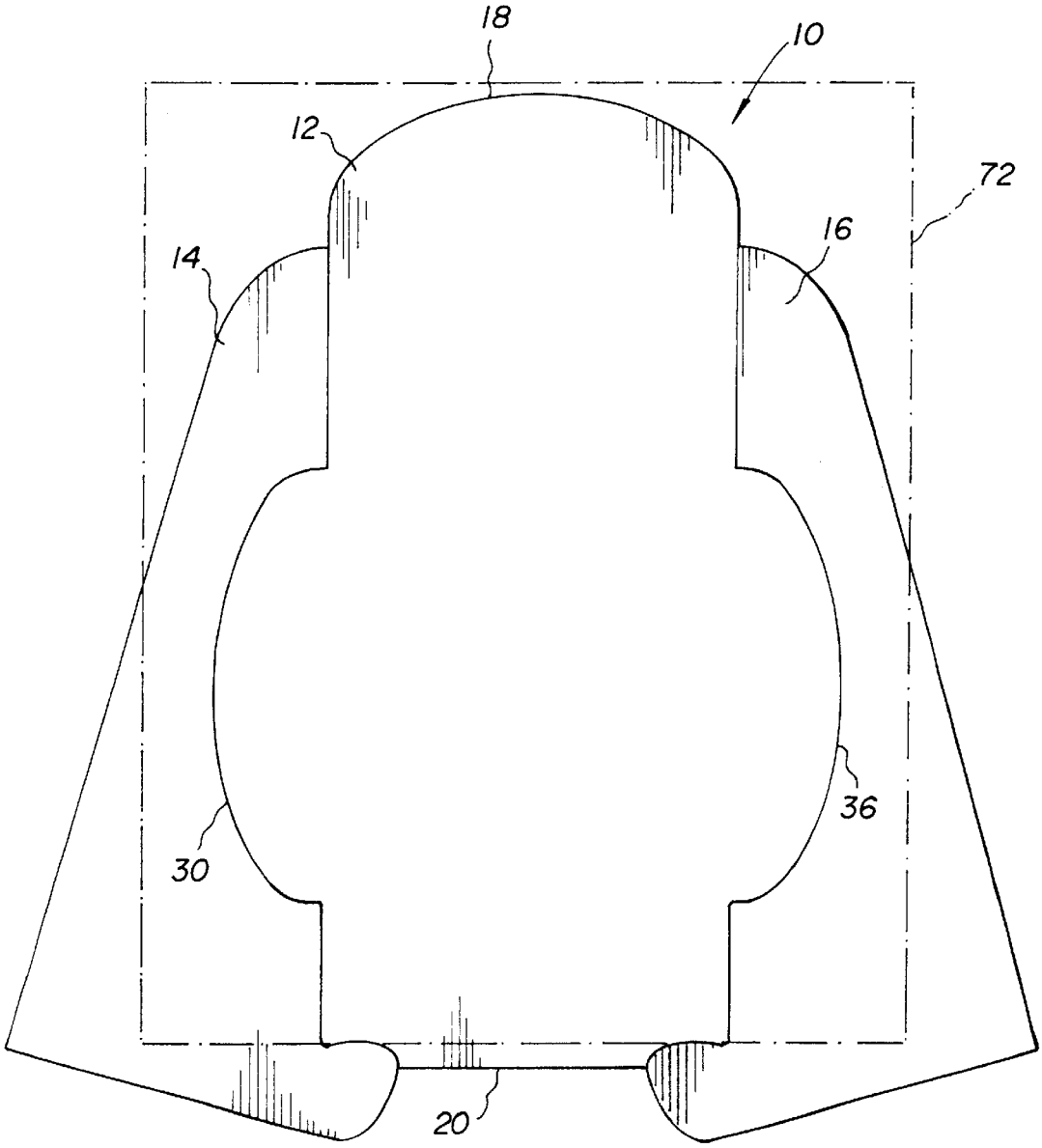
FIG. 4 illustrates a different version of the paper easel of the instant invention, with more curved outlines.

FIG. 4 illustrates the instant invention with slightly modified contour shape. In FIG. 4, paper easel 10 has a center panel 12 with opposing left and right wing panels 14, 16. Top edge 18 of center panel 12 has an outline curved in shape. Bottom edge 20 is flat. Left and right ear portions 30,36 are also curved in shape, mirroring the curved shape of top edge 18.

Figure 5:
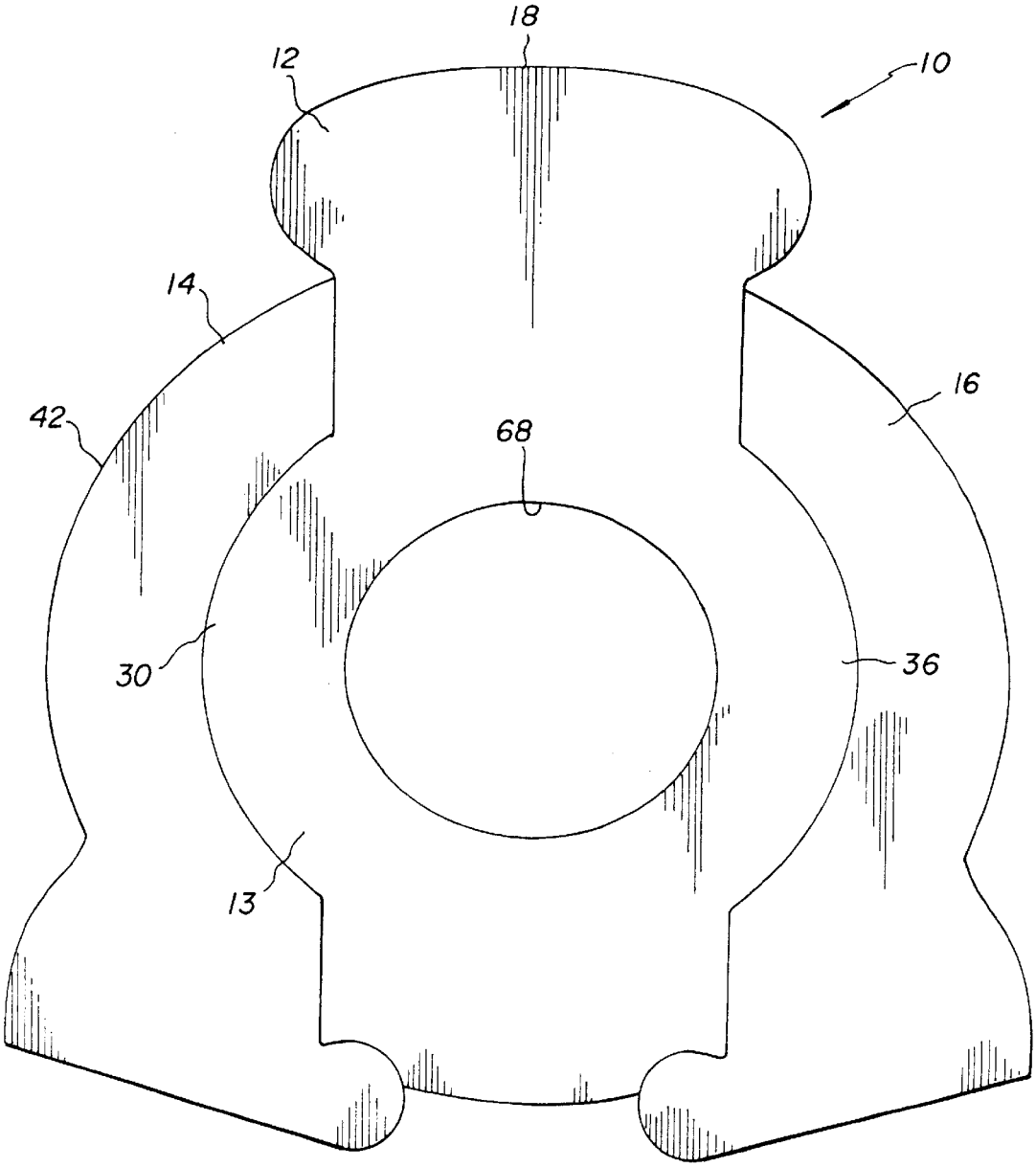
FIG. 5 illustrates another version of the paper easel in accordance with the instant invention, with oval type outlines.

FIG. 5 presents still another shape of paper easel 10. In FIG. 5, paper easel 10 has center panel 12 with top edge 18 in an oval shape. Left wing panel 14 has a rear edge 42 which also has an oval shape. Right wing panel 16 is substantially the mirror image shape of left wing panel 14. Center panel 12 also has left ear portion 30 and right ear portion 36, both of which form an oval shape. The paper easel 10 of FIG. 5 also has an oval shape for aperture 68 formed in center section 13 of center panel 12.

Figure 6:
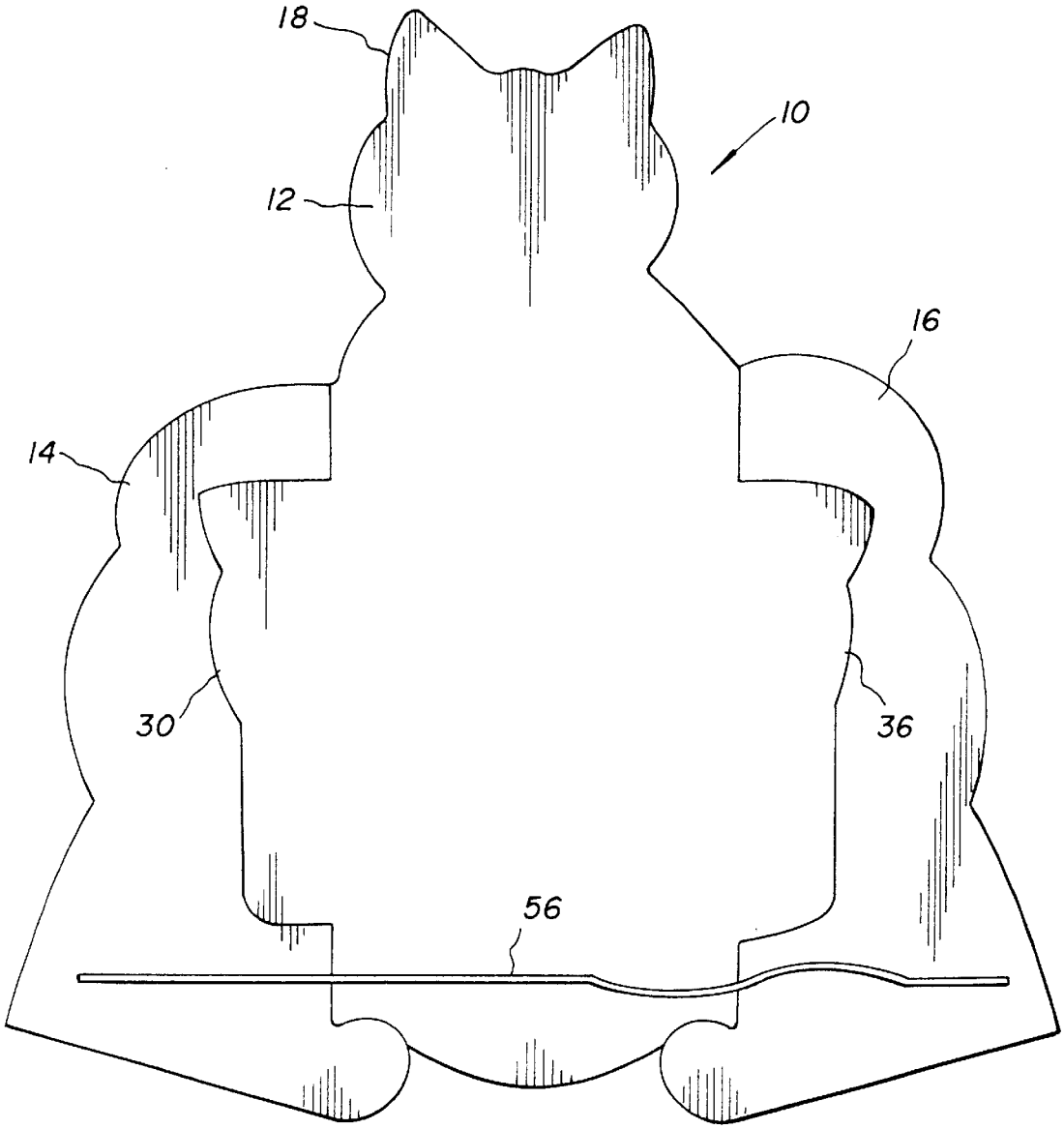
FIG. 6 illustrates a further version of the paper easel in accordance with the instant invention, with cat-shaped outlines.

FIG. 6 illustrates another shape of paper easel 10 of the instant invention. Specifically, center panel 12 has a top edge 18 which has an outline in the shape of a cat with a cat head and ears. Left and right ear portions 30, 36 are also formed into a shape that, in connection with left and right wing panels 14 and 16 continued the cat related theme. Additionally, an animal theme other than that of a cat may be used. For example, an outline of an animal head such as a dog's head or a racoon's head may also be used. As with a paper easel with a cat theme, designs of animals may be printed on the panels of the paper easel itself.

In operation, the flute wire 56 is inserted during manufacturing. Thus, when in use, a user may bend left wing panel 14 and right wing panel 16 back into their proper positions in order to allow a sheet of paper (or a plurality of paper sheets) to rest upon left and right foot panels 46, 54, leaving the surface of the paper to lean against center panel 12. While it is appropriate that center panel 12 be angled backwardly slightly from a strictly upright position (when compared to the work surface), any appropriate angle may be used. Appropriately, the angle which center panel 12 has with respect to the work surface is determined by the angle of each crease line with respect to its associated bottom edge. Of course, it is preferable that both sides be the same. For example, the angle between left crease line 27 and bottom edge 40 of left wing panel 14 determines the angle of center panel 12 with respect to the work surface 11. While this angle may be 90°, it is preferable that it be less than 90° so that papers sitting on the easel will not easily fall off.

When finished using paper easel 10, the user may unfold left and right wing panels. so that the entire paper easel 10 is flat, as illustrated in FIG. 2, for easy transportation. However, the user may also bend one or both of left and right wing panels 14, 16 back completely against the back of center panel 12 to provide a more compact package for transportation.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. A paper easel for supporting one or more sheets of paper on a work surface, said easel comprising:

a piece of bendable sheet material having only three panels, a center panel separating a right wing panel from a left wing panel, wherein said center panel is divided from said right wing panel by a right crease line such that said right wing panel is pivotable to an operating position with respect to said center panel along said right crease line, and wherein said center panel is divided from said left wing panel by a left crease line such that said left wing panel is pivotable to an operating position with respect to said center panel along said left crease line, and further wherein said left wing panel includes a bottom edge for resting on the work surface, and, in said operating position, a left foot panel extending forwardly from a lower front portion of said left wing panel, and said right wing panel includes a bottom edge for resting on the work surface, and, in said operating position, a right foot panel extending forwardly from a lower, front portion of said right wing panel.

2. The paper easel of claim 1, wherein said sheet material is corrugated cardboard.

3. The paper easel of claim 2, wherein corrugations of said corrugated cardboard run generally perpendicular to a center line of said center panel.

4. The paper easel of claim 3, wherein a flute wire is attached to said left wing panel, said center panel and said right wing panel.

5. The paper easel of claim 4, wherein said flute wire extends inside of said corrugated cardboard, along a corrugation thereof, from said left wing panel through said center panel and into said right wing panel.

6. The paper easel of either claim 1 or 5, wherein said center panel includes opposing left and right ear portions extending laterally outwardly from left and right side edges of said center panel, in the same plane thereof.

7. The paper easel of claim 6, wherein, an enlarged center section formed between said opposing ear portions, has a width greater than 5 inches.

8. The paper easel of claim 6, wherein, an enlarged center section formed between said opposing ear portions, has a width greater than 6 inches.

9. The paper easel of claim 6, wherein, an enlarged center section formed between said opposing ear portions, has a height greater than 3½ inches.

10. The paper easel of claim 6, wherein, an enlarged center section formed between said opposing ear portions, has a height greater than 4 inches.

11. The paper easel of claim 6, wherein an enlarged center section formed between said opposing ear portions has an aperture therein, for viewing a photo mounted on a rear face of said center panel.

12. The paper easel of claim 6, wherein a picture holder is mounted on a surface of a center section formed between said opposing ear portions.

13. The paper easel of claim 1, wherein a top edge of said center panel has a curved outline.

14. The paper easel of claim 1, wherein a top edge of said center panel has an oval outline.

15. The paper easel of claim 1, wherein a top edge of said center panel has an outline representative of an animal's head.

16. The paper easel of claim 15, wherein said top edge of said center panel has an outline representative of a cat's head.

17. The paper easel of claim 1, wherein said center panel includes a downwardly projecting panel, extending downwardly below a lower edge of a sheet of paper resting on said right and left foot panels.

18. The paper easel of claim 1, wherein at least a bottom edge of one of said left and right wing panels forms an angle of less than 90° with its corresponding crease line, so that said center panel is angled rearwardly.

19. The paper easel of claim 1, wherein said left crease line includes upper and lower crease portions and said right crease line includes upper and lower crease portions.

20. A paper easel for supporting one or more sheets of paper on a work surface, said easel comprising:

a corrugated cardboard sheet having only three panels, a center panel separating a right wing panel from a left wing panel, wherein said center panel is divided from said right wing panel by a right crease line such that said right wing panel is pivotable to an operating position with respect to said center panel along said right crease line, and wherein said center panel is divided from said left wing panel by a left crease line such that said left wing panel is pivotable to an operating position with respect to said center panel along said left crease line, and wherein said left wing panel includes a bottom edge for resting on the work surface and, in said operating position, a left foot panel extending forwardly from a lower front portion of said left wing panel, and said right wing panel includes a bottom edge for resting on the work surface and, in said operating position, a right foot panel extending forwardly from a lower front portion of said right wing panel, and wherein said center panel includes opposing left and right ear portions extending laterally outwardly from left and right side edges of said center panel, in the same plan thereof to form an enlarged center section, said center section having a sufficient size to accommodate at least a 3½×5 inch photograph mounted thereon, and further wherein an angle between a bottom edge of each of said left and right wing panels and each of said left and right crease lines, respectively, is less than 90°.

* * * * *